US007540120B2

(12) United States Patent
Miller

(10) Patent No.: US 7,540,120 B2
(45) Date of Patent: Jun. 2, 2009

(54) MULTI-LEVEL APARTMENT BUILDING

(76) Inventor: Allan S. Miller, 33-48 76th St., Jackson Heights, NY (US) 11372

( * ) Notice: Subject to any disclaimer, the term of this patent is extended or adjusted under 35 U.S.C. 154(b) by 541 days.

(21) Appl. No.: 10/948,025

(22) Filed: Sep. 23, 2004

(65) Prior Publication Data

US 2005/0115166 A1 Jun. 2, 2005

Related U.S. Application Data

(60) Provisional application No. 60/505,401, filed on Sep. 23, 2003.

(51) Int. Cl.

| | |
|---|---|
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 9/00*** | (2006.01) |
| ***E04H 14/00*** | (2006.01) |

(52) U.S. Cl. ..... 52/236.3; 52/79.1; 52/79.7; 52/79.14; 52/236.4; 52/236.7

(58) Field of Classification Search ..... 52/79.1, 52/236.3, 236.4, 236.7
See application file for complete search history.

(56) References Cited

U.S. PATENT DOCUMENTS

| | | | | |
|---|---|---|---|---|
| 3,503,170 | A | 3/1970 | Shelley | 52/227 |
| 3,513,607 | A | 5/1970 | Renes | 52/79 |
| 3,564,795 | A | 2/1971 | Henton | 52/79 |
| 3,605,354 | A | 9/1971 | Hodgetts | 52/73 |
| 3,656,266 | A | 4/1972 | Tylius | 52/30 |
| 3,694,973 | A | 10/1972 | Unger | 52/34 |
| 3,716,954 | A | 2/1973 | Kelbish | 52/79 |
| 3,724,143 | A | 4/1973 | Paulkulis | 52/79 |
| 3,742,666 | A | 7/1973 | Antoniou | 52/221 |
| 3,750,354 | A | 8/1973 | Boros | 52/236 |
| 3,805,461 | A | 4/1974 | Jagoda | 52/79 |
| 3,831,327 | A | 8/1974 | McCrillis et al. | 52/79 |
| 3,884,001 | A | 5/1975 | Tylius | 52/185 |
| 4,098,039 | A | 7/1978 | Sutelan | 52/73 |
| 4,120,133 | A | 10/1978 | Rodgers et al. | 52/475 |
| 4,211,043 | A | 7/1980 | Coday | 52/79.1 |

(Continued)

OTHER PUBLICATIONS

The Steinberg Collaborative, AIA, LLP Architechts and Planners (1999).

*Primary Examiner*—Brian E. Glessner
*Assistant Examiner*—Branon C Painter
(74) *Attorney, Agent, or Firm*—Brian Roffe

(57) ABSTRACT

A multi-level apartment building includes vertically stacked sections each containing at least one pair of apartments, where each apartment of an apartment pair contains a stairway assembly coupled to a vertically extending stair support wall assembly that contains utility distribution conduits. The stairway assembly for each apartment connects four levels of function space. One apartment of the pair in a vertical section is rotated 180 degrees in plan in relation to the other apartment of the pair which is entered on the opposite side of a public corridor that provides access to the apartments of the pair. The apartments are vertically stacked in alignment where an apartment of a pair is mirrored in plan in relation to a vertically underlying or overlying apartment of another pair, and the stair support assemblies of the respectively vertically stacked apartments are vertically aligned.

16 Claims, 17 Drawing Sheets

U.S. PATENT DOCUMENTS

| | | | | | |
|---|---|---|---|---|---|
| 4,248,020 | A | | 2/1981 | Zielinski et al. | 52/185 |
| 4,596,097 | A | | 6/1986 | Stewart et al. | 52/185 |
| 4,919,164 | A | | 4/1990 | Barenburg | 137/15 |
| 4,928,452 | A | * | 5/1990 | Sacks | 52/236.3 |
| 4,930,273 | A | | 6/1990 | Papesch | 52/79.1 |
| 5,076,310 | A | | 12/1991 | Barneburg | 137/15 |
| 5,528,866 | A | | 6/1996 | Yulkowski | 52/79.12 |
| 5,694,725 | A | * | 12/1997 | Kaufman et al. | 52/236.3 |
| 5,809,704 | A | | 9/1998 | Stewart et al. | 52/169.4 |
| 5,941,034 | A | | 8/1999 | Frankfurt | 52/236.3 |
| 6,393,774 | B1 | | 5/2002 | Fisher | 52/79.1 |
| 6,578,330 | B1 | | 6/2003 | Bergman | 52/234 |
| 6,625,937 | B1 | | 9/2003 | Parker et al. | 52/79.7 |
| 6,651,393 | B2 | | 11/2003 | Don et al. | 52/79.5 |
| 6,688,055 | B2 | | 2/2004 | Lindsley | 52/236.4 |
| 6,698,147 | B2 | | 3/2004 | Bergman | 52/234 |
| 6,922,960 | B2 | * | 8/2005 | Sataka | 52/236.3 |
| 2002/0095891 | A1 | | 7/2002 | Duany | 52/243 |

* cited by examiner 5A
5B
11
4A
4B
4C
BR 2
MBR
10B
BR 3
+15 R
+19 R
D
10A
K/DR
A
34
L
B
0 R
-4 R
25
-18 R
C
29
-14 R PLAN
L - SECTION
CROSS SECTION
VARIES
K / DR
BR
MBR
L
BR 2
BR 3
10A
A
B
C
D
+20 R
+16 R
+9 R
0.0
-4 R
-15 R
-19 R PLAN
LONG. SECTION
CROSS SECTION
VARIES
K / DR
BR
MBR
L
BR 2
BR 3
10A
A
B
C
D
+19 R
+20 R
+16 R
-4 R
-19 R
-15 R
0 R
+20 R
+16 R
+9 R
0.0
-4 R
-15 R
-19 R

LONG. SECTION
PLAN
CROSS SECTION

VARIES
K/DR
BR
MBR
L
BR 2
BR 3
10A
A
B
D
+20 R
+18 R
+9 R
0.0
-4 R
-15 R
-19 R

MULTI-LEVEL APARTMENT BUILDING

CROSS REFERENCE TO RELATED APPLICATION

This application claims the benefit of U.S. Provisional Application No. 60/505,401 filed Sep. 23, 2003, incorporated by reference herein.

FIELD OF THE INVENTION

The present invention relates generally to a multi-level structure and, more particularly, to a multi-level apartment building having a plurality of apartments, where each apartment includes a plurality of rooms on levels connected by a stairway system that is coupled to a stair support wall assembly for receiving vertically extending utility services.

BACKGROUND OF THE INVENTION

Multi-level buildings are a favored form of residential construction because they provide for improved land use and a high density alternative to sprawl. The buildings usually include a plurality of apartments where each of the apartments is occupied by several individuals, such as a family. Such apartments, however, usually do not include all of the features and amenities that are ordinarily present in a detached suburban home. The apartments typically do not include such detached home features as split level living room and dining room function space, duplex height in a living room function space, duplex height windows as part of the living room space and that provide natural lighting to remote interior portions of the apartment, bedrooms located on separate levels to afford privacy from each other and also communal activities, views on opposite sides of a building, through ventilation, an exposed interior duplex height stairway and balconies without shadows and overhangs. The absence of many of the features and amenities usually present in a detached residence makes conventional apartments unappealing to the more mobile class of residential purchasers.

The ever-increasing scarcity of land available for residential use in urban areas has raised the price of such land, thereby making less space available for construction of apartment buildings and commensurately less space available for each apartment within each building.

Therefore, a need exists for a multi-level apartment building that addresses the needs of sprawling development by containing a plurality of apartments that can be fabricated with relative ease and where each apartment creates the illusion of spaciousness while providing expected amenities and consuming a minimum of floor area.

SUMMARY OF THE INVENTION

In accordance with the present invention, a multi-level building system includes a plurality of vertical sections, where each vertical section includes at least one pair of apartments and where one of the apartments of the pair is rotated 180 degrees in plan in relation to the other apartment of the pair which is on the opposite side of a central public corridor. Each of the apartments includes four levels connected by a stairway system that is coupled to a vertically, rectilinearly extending structural stair support wall assembly which contains utility conduits. The public corridor provides access to the pair of the apartments of the vertical section at an entry level. The levels correspond to respective modules that are vertically and horizontally spaced from one another to afford privacy and amenities based on the functions designated to the respective modules. The pairs of apartments are vertically stacked in alignment in the building such that an apartment of a pair is mirrored in plan in relation to a vertically underlying or overlying apartment of another pair, and the stair support assemblies of the respective vertically stacked apartments are vertically aligned to permit a continuous straight line path for vertical utility building services.

In a preferred embodiment, a multistory apartment building includes a plurality of vertical sections stacked one over the other, where each vertical section includes a pair of identical apartments disposed about a public corridor and where one apartment of the pair is rotated 180 degrees in relation to the other apartment of the pair. In the apartment building, each apartment includes four levels connected by a stairway system coupled to a stair support wall assembly. The stairway system connects split-level living and dining function space, where the living room function space has duplex height and includes duplex height glazing that permits clerestory daylighting deep into the interior of the apartment. In addition, each apartment includes bedroom and bathroom function spaces having conventional head room height to provide intimacy and privacy. Kitchen, dining and entry function spaces in each apartment have intermediate head room height that exceeds the conventional height to provide less intimacy relative to the bedroom and bathroom function spaces. Further, in each apartment a master bedroom is disposed on a separate level below the living room level and also below a minor bedroom, which is disposed above the living room level. The master and minor bedrooms of an apartment are disposed on an opposite side of the public corridor than the kitchen, dining room and living room of the apartment, such that the apartment has through (cross) ventilation and the master and minor bedrooms provide the apartment with external views on one side of the building and the kitchen, dining room and living rooms provide external views on the opposite side of the building. The interior stairway system preferably is ornamental, projects into the duplex height space of the living room and is exposed on four sides. An internal balcony on the upper minor bedroom level overlooks the duplex height living room space.

In a further preferred embodiment, each apartment in the building includes an external balcony that extends from the living and/or dining levels and is five stories below a balcony of a higher, vertically adjacent apartment in the building that is identical to the apartment below. This vertical separation between balconies of vertically adjacent apartments in the building provides the ambience of a shadowless, open terrace, makes the balcony of an apartment more conducive to gardening and admits more light into the apartment than a balcony of an apartment in a conventional building containing vertically aligned apartments.

BRIEF DESCRIPTION OF THE DRAWINGS

Other objects and advantages of the present invention will be apparent from the following detailed description of the presently preferred embodiments, which description should be considered in conjunction with the accompanying drawings in which like references indicate similar elements and in which:

FIG. 6 shows a furnished view of a Living Room from the Entry landing 32L toward a window.

FIG. 7 shows a furnished view of a Living Room from the interior balcony region 69 toward a window.

FIG. 8 shows a furnished view of a Living Room from the window toward the interior stair, showing the interior balcony, Entry landing 32L, and Kitchen Dining.

DETAILED DESCRIPTION OF THE INVENTION

Figure 1:
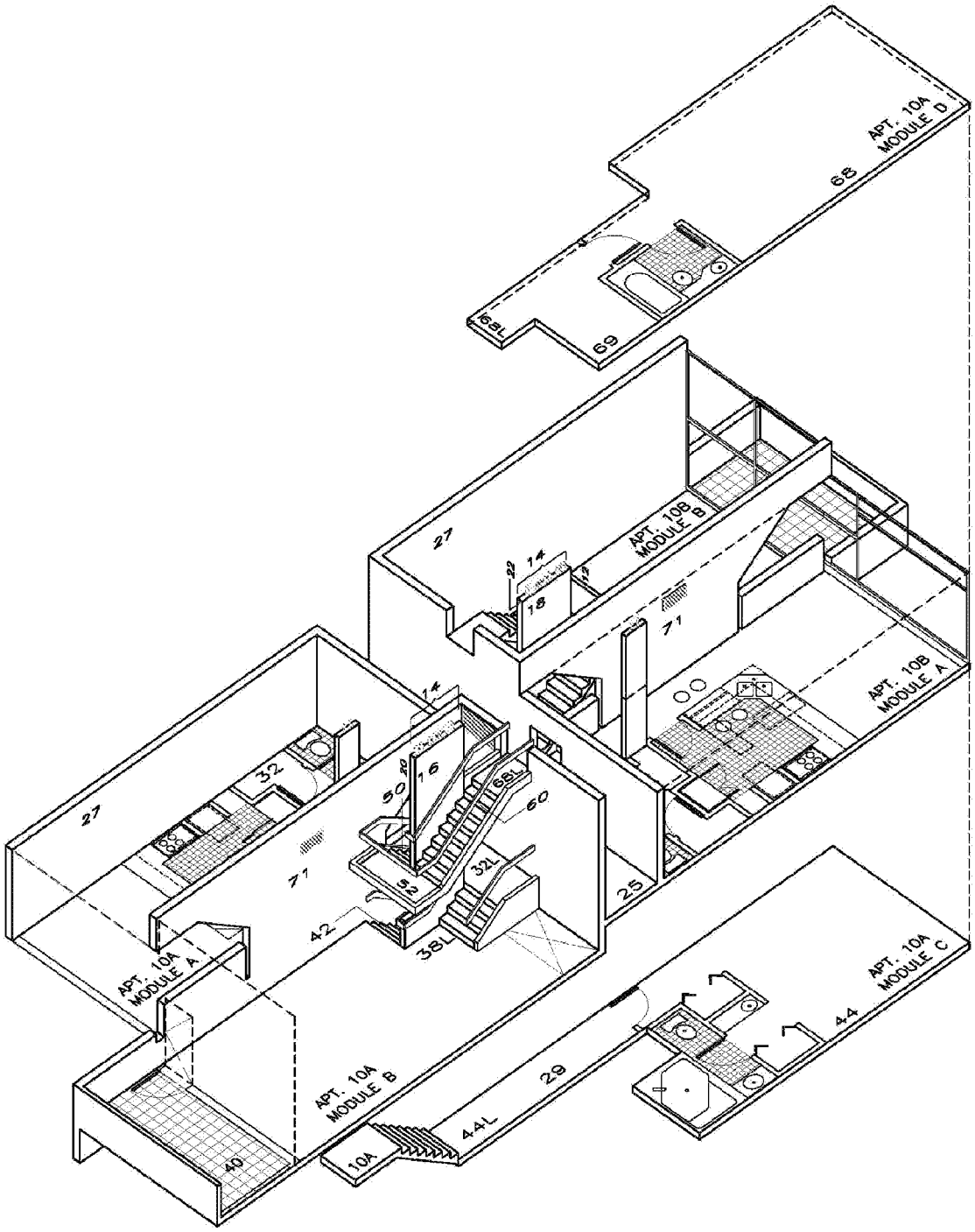
FIG. 1 is an exploded, axonometric view of portions of a pair of apartments contained in a vertical section of an apartment building in accordance with the present invention.

FIG. 1 shows an axonometric view of a pair of preferred, four level apartments 10A and 10B which are identical to each other and are included in a vertical section of a multiple apartment building 11 containing a plurality of vertical sections in accordance with the present invention. The building 11 preferably includes a plurality of pairs of the apartments 10A and 10B vertically stacked in an alternating mirrored pattern and a plurality of such vertically stacked pairs of apartments horizontally aligned with one another, as shown in FIGS. 3A, 3B, 3C, 3D, 4A, 4B, 4C, 5 and 12, and discussed in greater detail below. For clarity and ease of reference, the apartment 10A is described in detail below with reference to Modules A, B, C and D, which correspond to the levels in the apartment 10 that respectively provide a set of functions or activities. All of the apartments 10 in the building 11 are preferably constructed and configured the same as the apartment 10A. As used herein, conventional height is standard head room, such as eight feet from floor to ceiling, and duplex height is less than twice conventional ceiling height.

Referring to FIG. 1, each pair of the apartments 10 in the building 11 has a rectangular footprint and a simple, rectilinear high-rise slab profile defined by the Modules A, B, C and D. This floor plan configuration provides that a plurality of the apartments 10 can be readily and easily constructed, using conventional or industrial prefabrication techniques that provide for economies of scale, and then vertically stacked in a high rise apartment building, as shown in FIGS. 4A, 4B, 4C, 5 and 12. Referring to FIGS. 1, 3A, 3B, 3C and 3D, the apartments 10A and 10B have the same layout, except that the apartment 10A is rotated 180 degrees in relation to the apartment 10B which is on the opposite side of a central public corridor 25 of the building 11, such that access to the apartment 10A is located on the opposite side of the corridor 25 from where access to the apartment 10B is located. Co-planar demising walls 27 bounding the apartments 10A and 10B align on either side of the public corridor 25.

Figure 2:
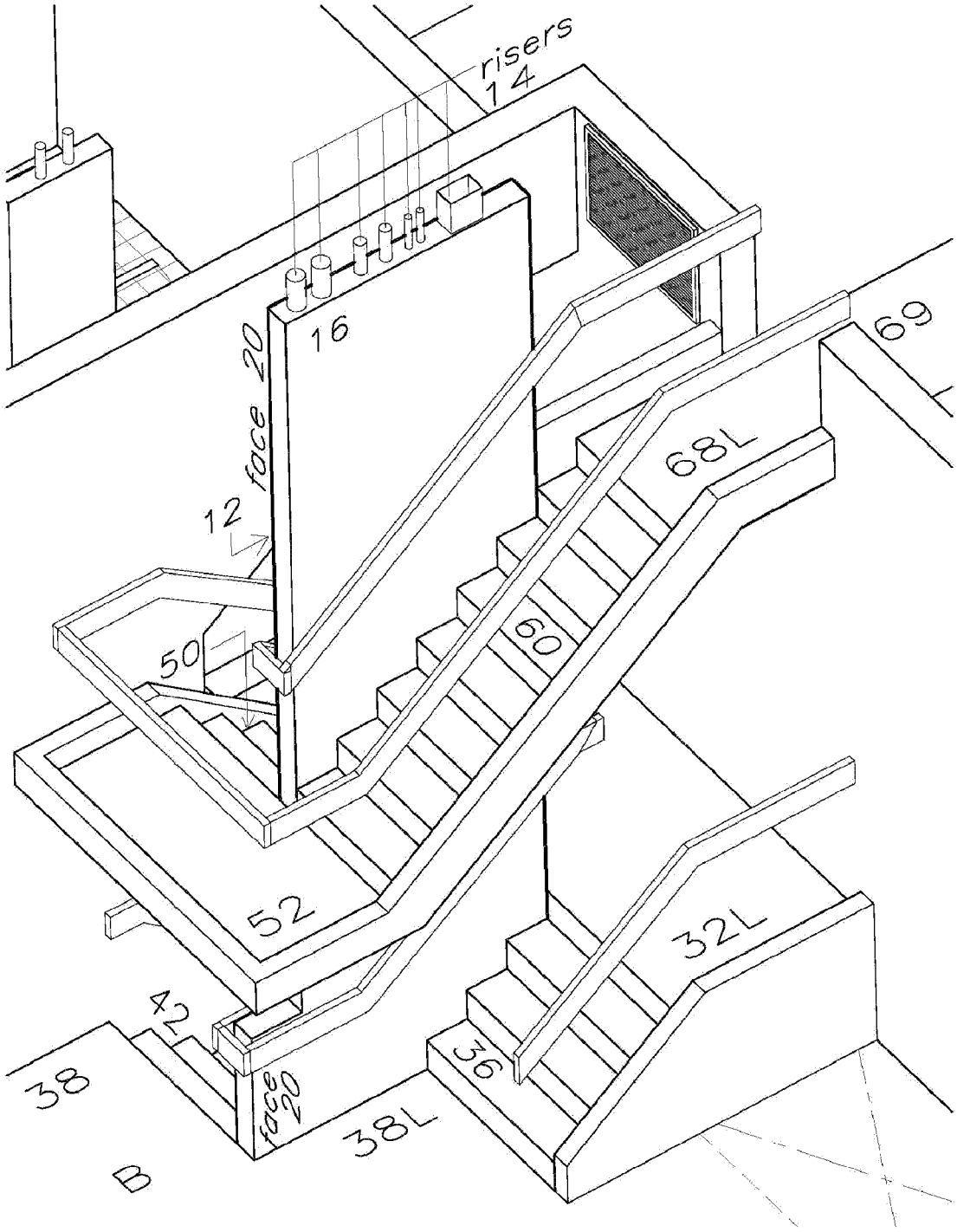
FIG. 2 is an enlarged, partial view of an interior stairway assembly coupled to a stair support wall assembly of an apartment of FIG. 1.

Referring to FIGS. 1 and 2, each of the apartments 10 in the building 11 contains a rectilinearly, vertically extending stair support wall assembly 12. The support assembly 12 in one apartment 10 is vertically aligned with the support assembly 12 of another apartment 10 which vertically underlies or overlies the one apartment. The support assembly 12 contains rectilinearly, vertically extending utility service conduits 14. The conduits 14 are used to receive standard utility services, such as HVAC, plumbing, exhaust, etc., that extend in vertical, straight line paths in the building 11. Thus, the single stair support assembly vertically extending in each of a plurality of vertically aligned apartments functions to consolidate plumbing, HVAC and other utilities into a single assembly having a straight, vertical and unobstructed path.

Referring to FIGS. 1 and 2. the support assembly 12 includes two flat major faces 16 and 18 and two flat lateral faces 20 and 22. The major faces 16 and 18 have the same widths and the faces 20 and 22 have the same widths, which are different than the widths of the major faces 16 and 18, where the face 22 faces the public corridor 25.

Figures 3A, 3B, 3C, 3D:
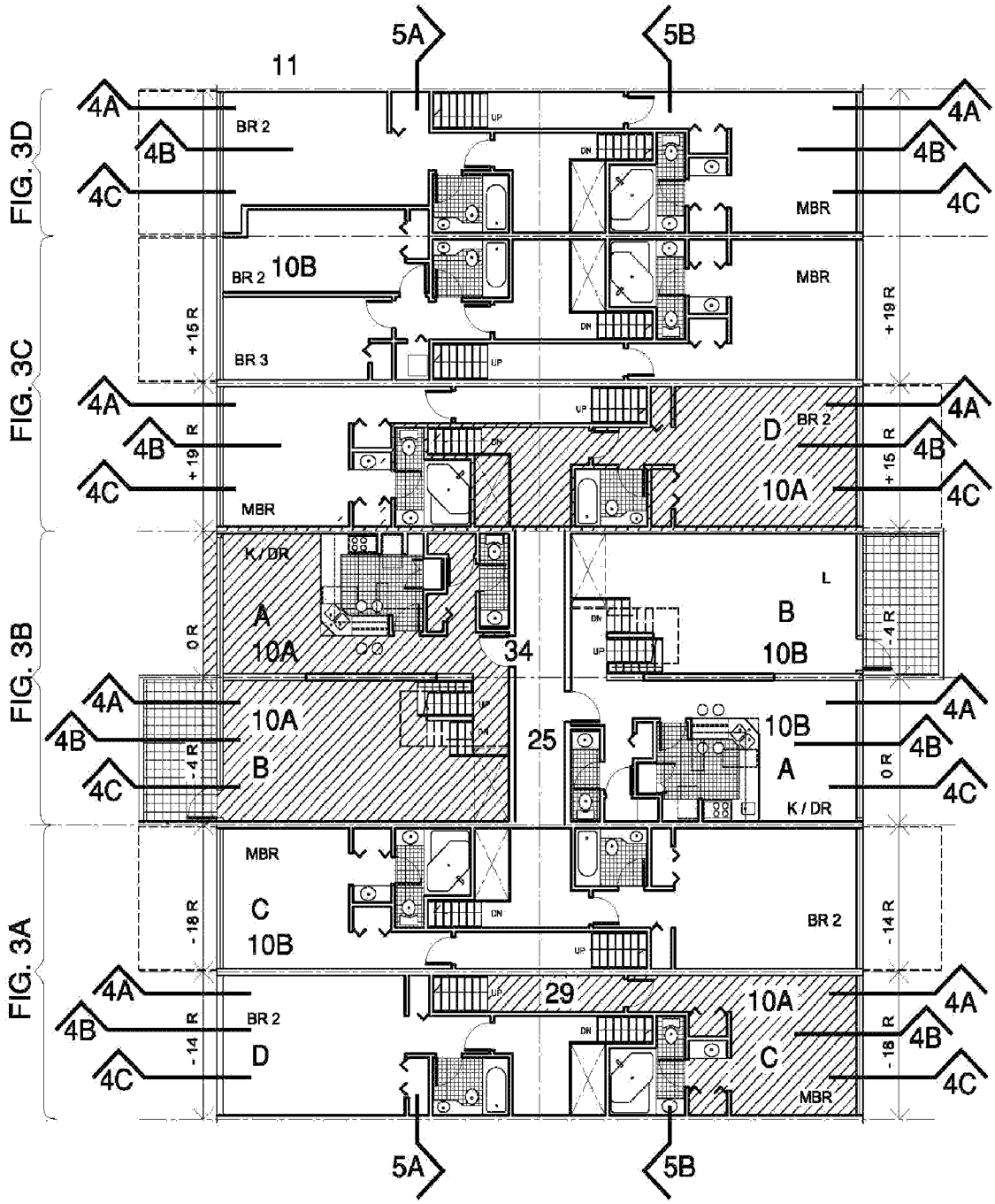
FIGS. 3A, 3B, 3C and 3D are plans of levels of a plurality of identical apartments in an apartment building as they appear along stepped section line 3 in FIG. 5, and reflected in the individual section 3B seeen in cross-sections in FIGS. 4A, 4B and 4C.
Figure 9:
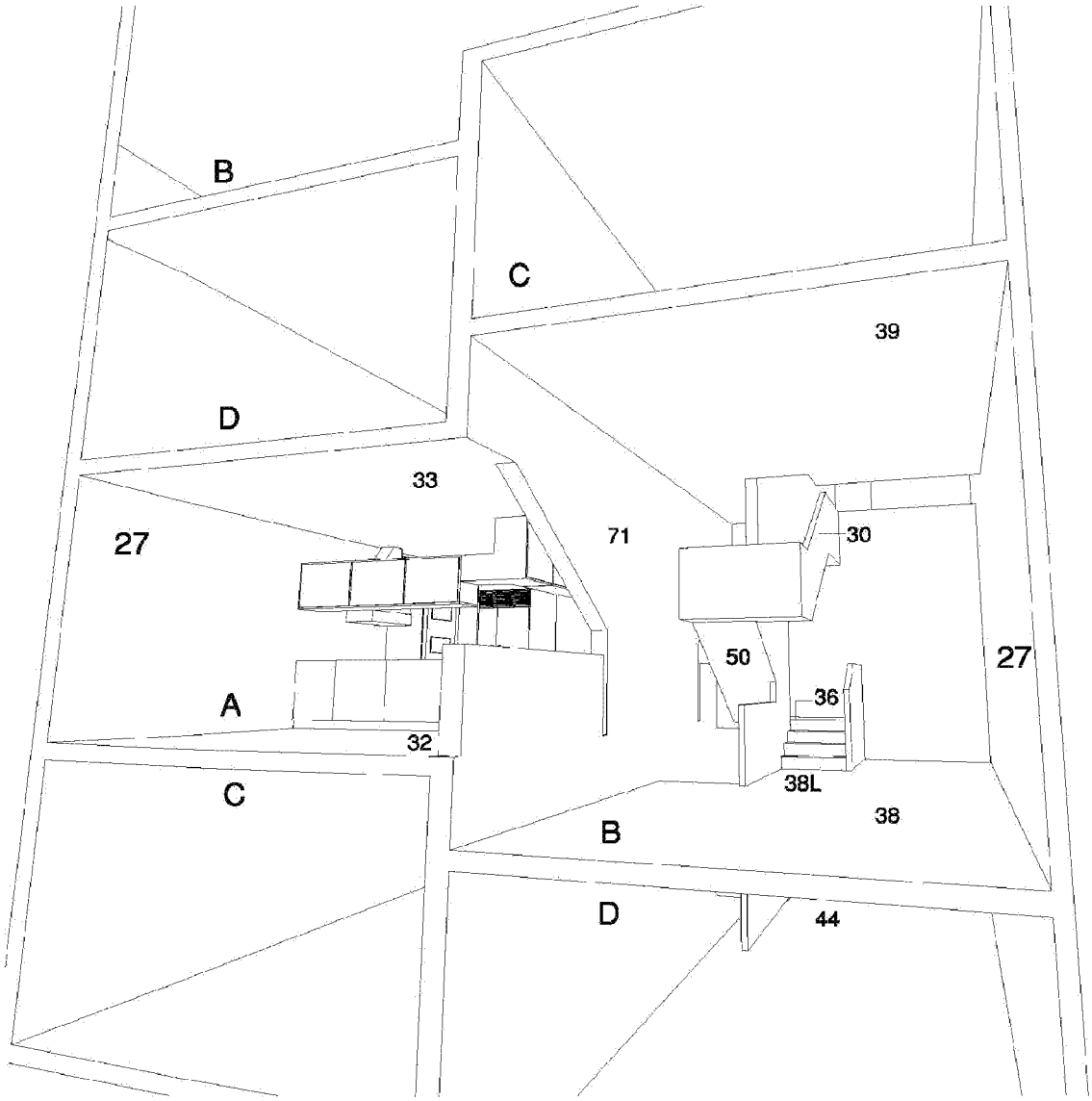
FIG. 9 is a schematic perspective view from the location of the exterior balcony (not shown) toward the interior stairway and interior balcony of the upper bedroom level of a preferred apartment in accordance with the present invention.
Figure 10:
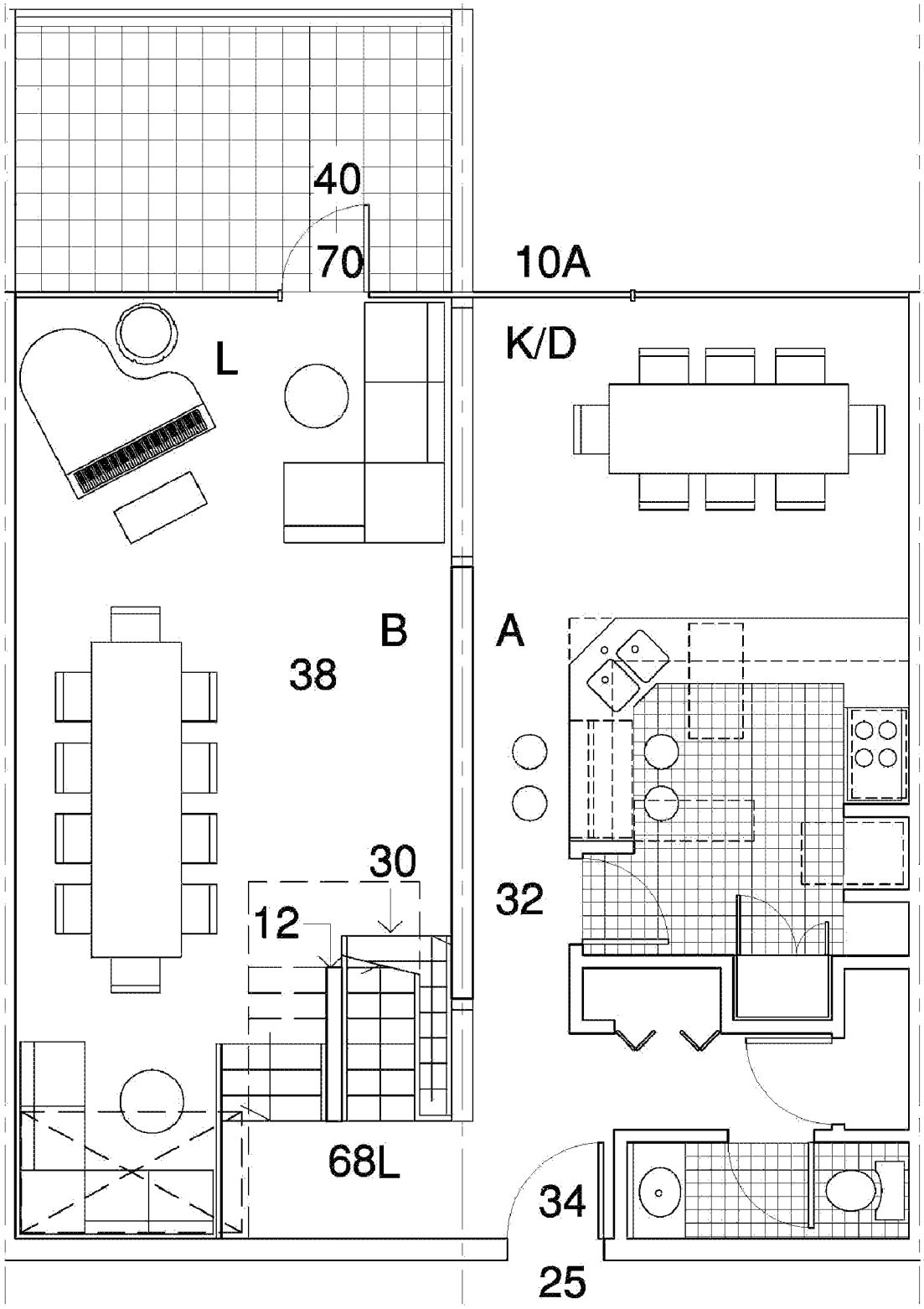
FIG. 10 is a scale plan of the entry and dining level, living room and balcony levels of a preferred apartment in accordance with the present invention showing the utilization of minimal horizontal floor space for a conventional furniture layout.
Figure 11:
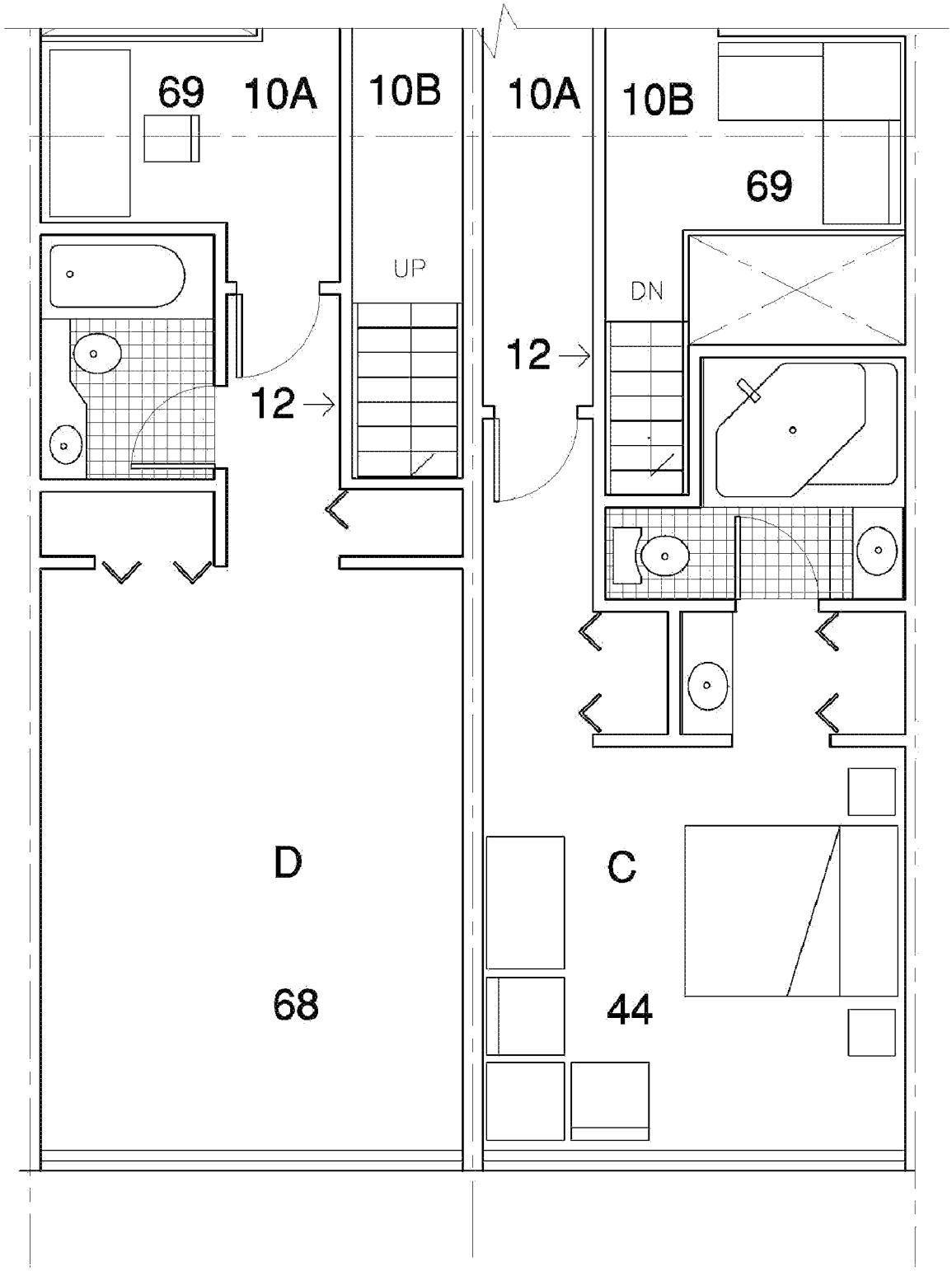
FIG. 11 is a plan of master bedroom and minor bedroom levels of a preferred apartment in accordance with the present invention showing the utilization of minimal horizontal floor space for a conventional furniture layout.
Figure 12:
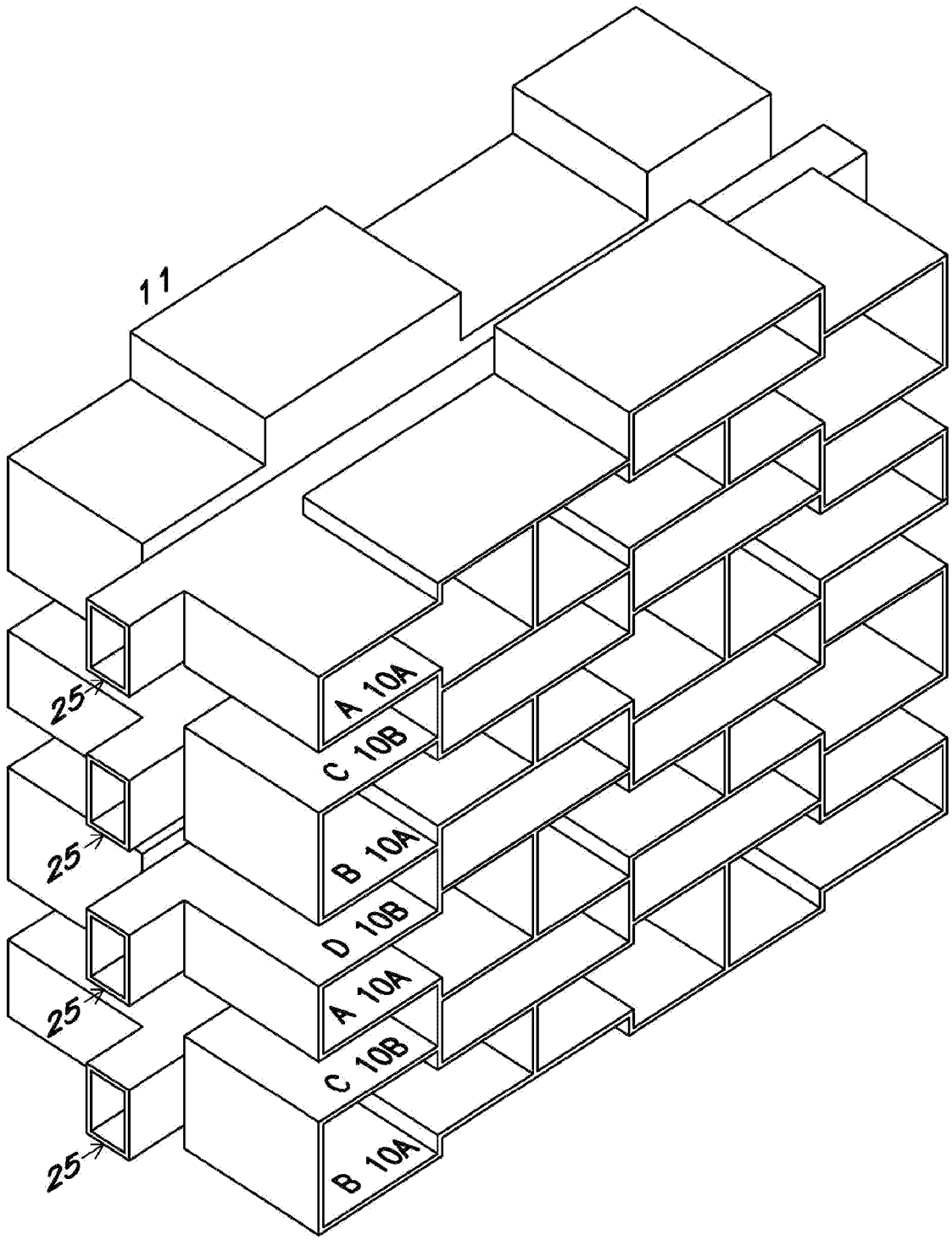
FIG. 12 is a schematic axonometric volume study of a plurality of stacked vertical sections of pairs of apartments in an apartment building in accordance with the present invention. Demising bearing walls 27 and intermediate bearing walls 71 have been partially omitted to reveal the pattern of the Modules A, B, C, and D.

In accordance with a preferred embodiment of the present invention, each apartment 10 in the building 11 includes features normally found in a detached suburban home and is configured as a four level residence including an interior stairway system 30 that is coupled to a vertically extending stair support assembly 12. Referring to FIGS. 1, 2, 3A, 3B, 3C, 3D, 4A, 4B, 4C and 5, the apartment 10A includes a first base or entry level 32 that provides access to the public corridor 25 and constitutes the Module A. The base level 32 extends along the lateral face 22 of the support assembly 12 to define an entry landing 32L that is a part of and co-planar with the level 32 and extends away from the face 18 of the support assembly 12. The Module A on the level 32 preferably includes kitchen and dining, powder room, wardrobe and ancillary function space, as shown in FIGS. 9-10. Referring to FIGS. 3B and 10, an entry door 34 on the base level 32 provides access from the apartment 10A to the corridor 25.

Figure 6:
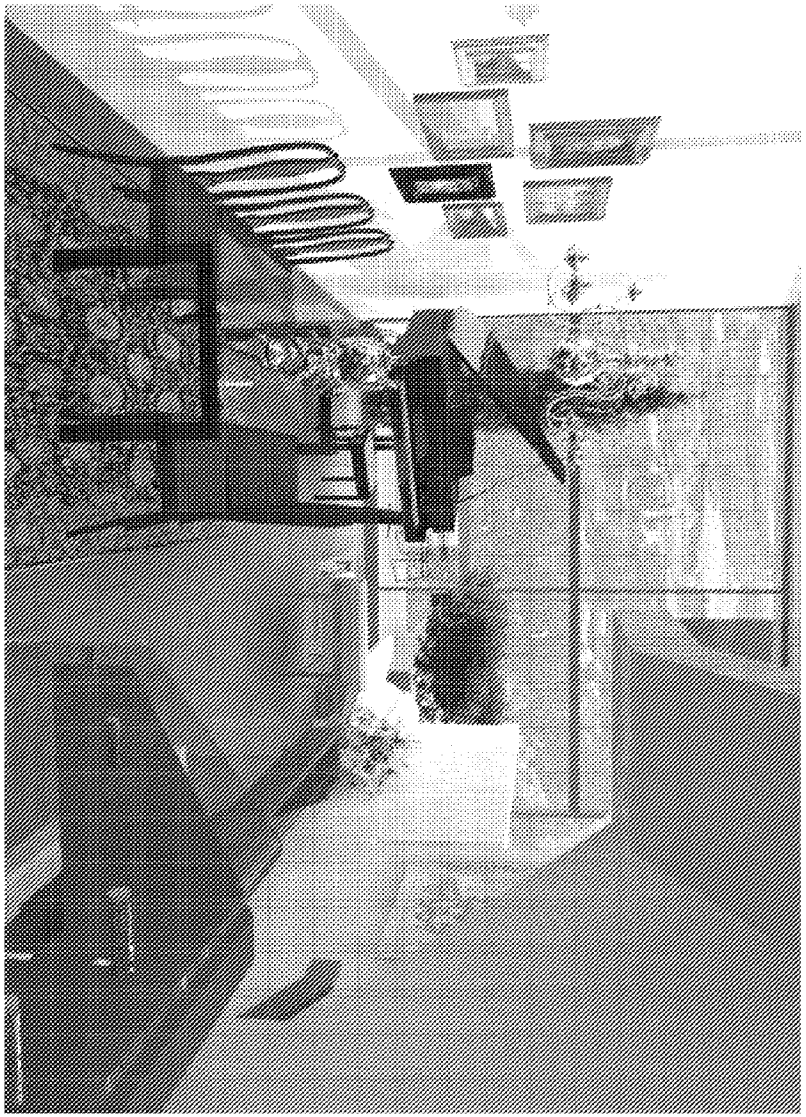
FIG. 6 is a rendered perspective view toward the living room level from the entry level of a preferred apartment in accordance with the present invention.
Figure 7:
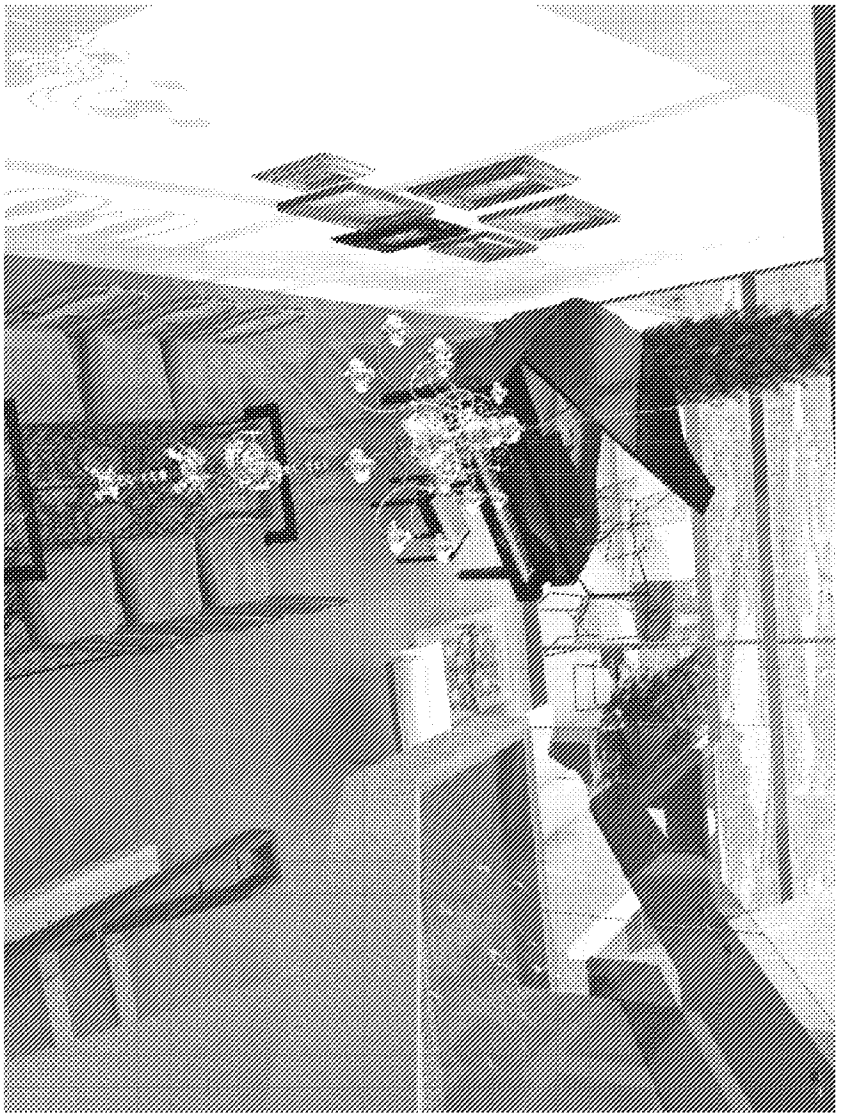
FIG. 7 is a rendered perspective view from the interior balcony of the upper bedroom level toward the living room level of a preferred apartment in accordance with the present invention.

Referring again to FIGS. 1 and 2, the stairway system 30 in the apartment 10A includes a first set of risers 36 of a predetermined height extending along the major face 16 between the base level 32 and a landing 38L that is part of and coplanar with a level 38. The level 38 constitutes the Module B, and the Module B is preferably located one-split level below the Module A. The level 38 abuts the lateral face 20 and extends in a direction away from the major face 16 and the lateral face 20. The Module B preferably includes living room function space, as shown in FIGS. 6-8 and 10. Referring to FIGS. 6, 7 and 10, the level 38 extends through an outside door 39 to an exterior balcony 40.

Referring once again to FIGS. 1, 2 and 9, the stairway system 30 further includes a second set of risers 42 of a predetermined height extending along the major face 18 between the landing 38L and a landing 44L. The landing 44L is part of and co-planar with a level 44 that constitutes the Module C. The Module C is preferably located a split-level below the Module B. The landing 44L abuts the lateral face 22 and the major face 18 and extends away therefrom. The Module C preferably includes a master bedroom, bath and ancillary function space.

In addition, referring to FIGS. 1, 2 and 9, the stairway system 30 includes a third set of risers 50 of a predetermined height extending along the major face 18 between the base level 32 and a platform 52. The platform 52 is above the base level 38 and abuts the lateral face 20.

Further, referring to FIGS. 1-2, the stairway system 30 includes a fourth set of risers 60 of a predetermined height extending along the major face 16 between the platform 52 and a landing 68L. The landing 68L is a part of and co-planar with a level 68 that constitutes the Module D. The Module D is preferably located a full story above the entry level 38. The level 68 extends away from the lateral face 22. The Module D preferably includes one or more minor bedrooms, shared bath and ancillary function space, and an open sitting area behind an interior balcony that overlooks the living room of the Module B.

Figure 8:
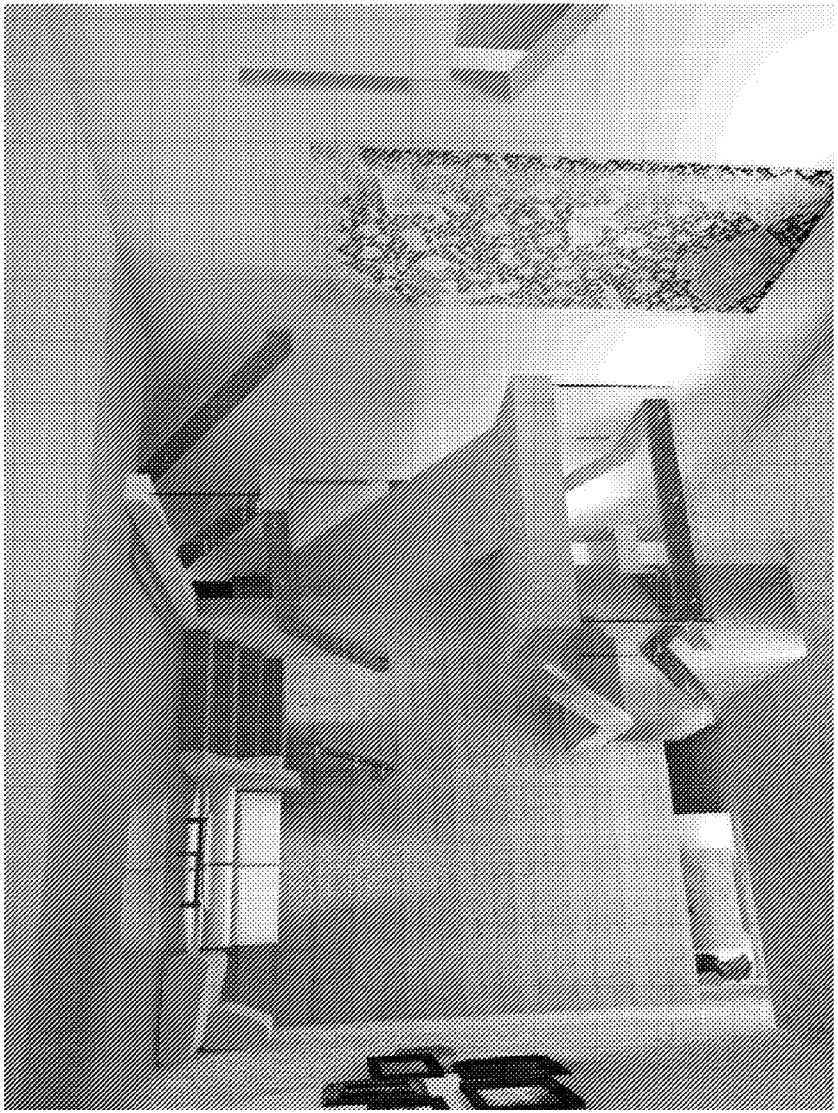
FIG. 8 is a rendered perspective view from living room level toward the interior stairway and interior balcony of the upper bedroom level of a preferred apartment in accordance with the present invention.

Referring to FIGS. 1, 3A, 3B, 3C, 3D, 4A, 4B, 4C and 5, the Modules A, B, C and D of the respective apartment pairs 10A, 10B are arranged in a rectangular plan in the building 11 such that the Modules A and B face one exposure, or façade, on one side of the public corridor 25, the Modules C and D face the opposite exposure, on the other side of the public corridor 25 and the Module C connects to the Module B via an interior corridor 29 which crosses beneath the public corridor 25. The Module D crosses above the public corridor 25 at the top of the interior stairway system 30. Referring to FIGS. 1, 2 and 8, the stairway system 30, which is preferably an exposed ornamental stair system, projects into the Module B and connects all levels (Modules) within the apartment.

Referring to FIGS. 3A, 3B, 3C, 3D, 4A, 4B, 4C and 5, adjacent apartments 10 on one side of the public corridor 25 are horizontally arranged to provide that the apartments are disposed as mirror images, such that the Module A of a first apartment is placed contiguous with the Module A of the adjacent second apartment, and the Module B of the second apartment is placed contiguous with the Module B of the next adjacent apartment. The apartments on the other side of the public corridor 25 are horizontally arranged such that the demising boundary walls 27 of the two apartments of a pair of apartments 10A and 10B align and are coplanar, where one apartment of the pair is rotated 180 degrees in plan in relation to the other apartment of the pair that is on the opposite side of the public corridor 25 (see FIG. 9). Thus, the Module A of a first apartment of the pair is opposite the Module B of the second apartment on the opposite side of the public corridor 25, and the Module B of the first apartment is opposite the Module A of the second apartment on the opposite side of the public corridor 25.

Thus, referring again to FIGS. 1, 3B, 4B and 12, the corridor 25 in the building 11 is a central, straight double-loaded corridor and is located one conventional story above the master bedroom level 44 for the apartments to which the corridor 25 provides access. The corridor 25 optimizes access and egress to the apartments 10A and 10B in that access to the corridor 25 can be obtained at both ends of the building 11. In addition, the corridor 25 can connect readily to fire stairs and elevators at the ends of the building 11 consuming a minimum of lobby space. Advantageously, the corridor 25 occurs at every two and one-half conventional stories in the building 11, rather than on each story in a building as in many prior art buildings. Consequently, the corridors 25 in the building 11 consume proportionately less space, such that less space is devoted to non-rentable or non-saleable common space. Therefore, more space can be allocated to the apartments 10 within the building 11 and net-to-gross area losses are minimized. Thus, the corridors 25 contribute to the repetitive plan for the building 11 where the apartments 10 define living space for rent or purchase which is symmetrical in cross-section about the corridor 25.

Referring to FIGS. 3A, 3B, 3C, 3D, 4A, 4B, 4C and 5, apartments on one side of the public corridor 25 are vertically arranged such that a Module C of a first apartment is disposed above a Module B of another apartment that has an entry door on the opposite side of the next public corridor below. In addition, a Module D of one apartment is disposed above a Module A of another apartment that has an entry door on the opposite side of the same public corridor as the aforementioned Module A.

Thus, the apartment 10 design positions the function space corresponding to the levels 44 and 68 on an opposite side of the building 11 than the function space corresponding to the levels 32 and 38, as shown in FIGS. 3A, 3B and 3C, such that each of the apartments 10 in the building 11 has an external view on the opposite sides of the building 11 and also through ventilation. In the preferred embodiment, the master and minor bedrooms are disposed on an opposite side of the apartment 10 than the kitchen, dining room and living room, such that the master and minor bedrooms provide the apartment with external views on one side of the building and the kitchen, dining room and living rooms provide external views on the opposite side of the building. Further, the preferred apartment 10 design also devotes the separate level 44 constituting the Module C to master bedroom function space where the level 44 is remote from the level 68 that constitutes the Module D and devoted to minor bedroom function space. By separating the master bedroom from the minor bedroom space by more than one story in the apartment 10, an enhanced sense of privacy is provided for each bedroom in the context of the limitation on horizontal floor space for the entire apartment.

Figures 13A, 13B, 13C:
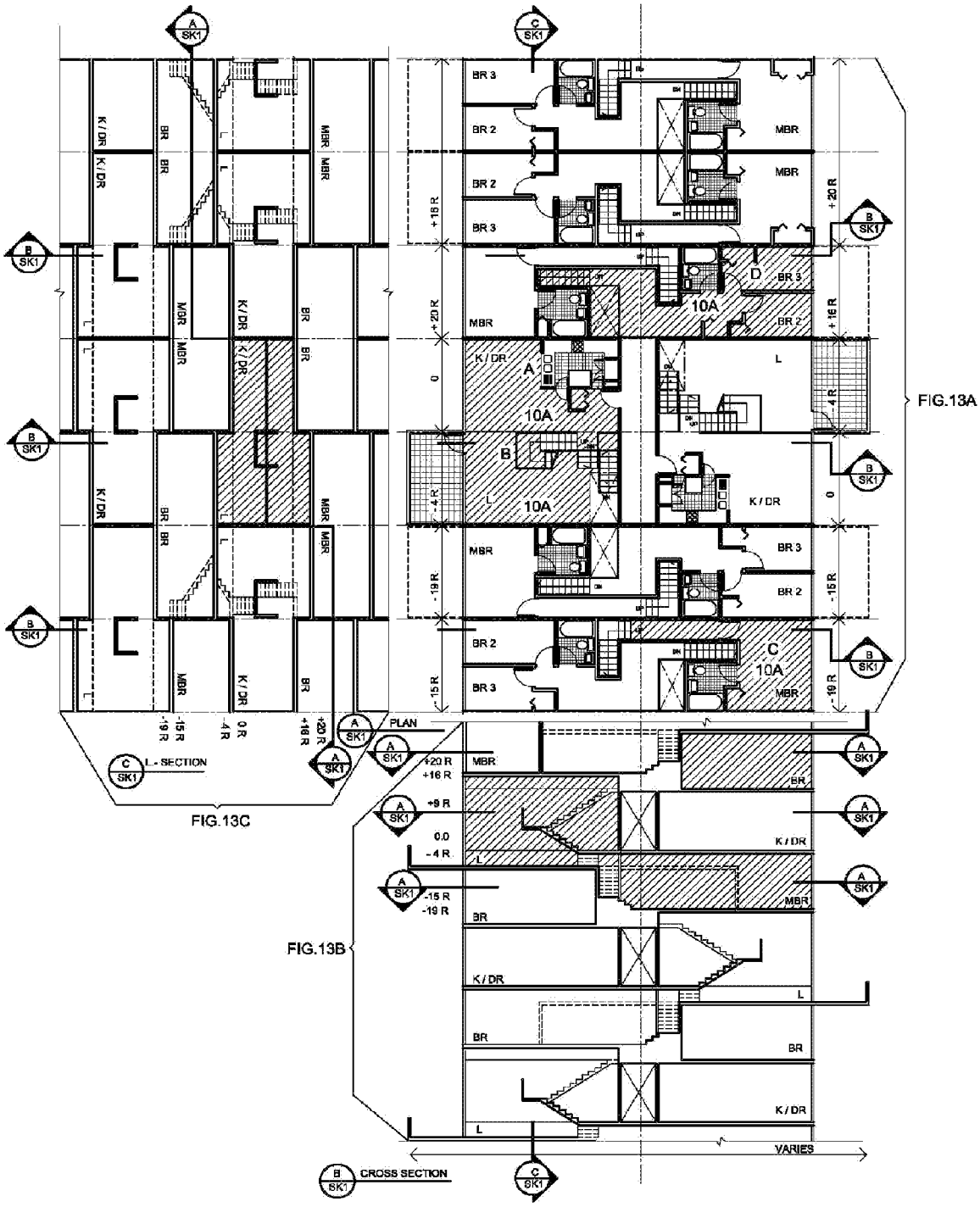
FIG. 13A shows orthographic plans.
FIG. 13B shows cross sections and FIG. 13C shows a longitudinal section of a plurality of identical apartments in an apartment building mirrored in one horizontal axis on one side of a public corridor and rotated 180 degrees in the other axis across the public corridor where the apartments include a second preferred stairway system in accordance with the present invention.
Figures 14A, 14B, 14C:
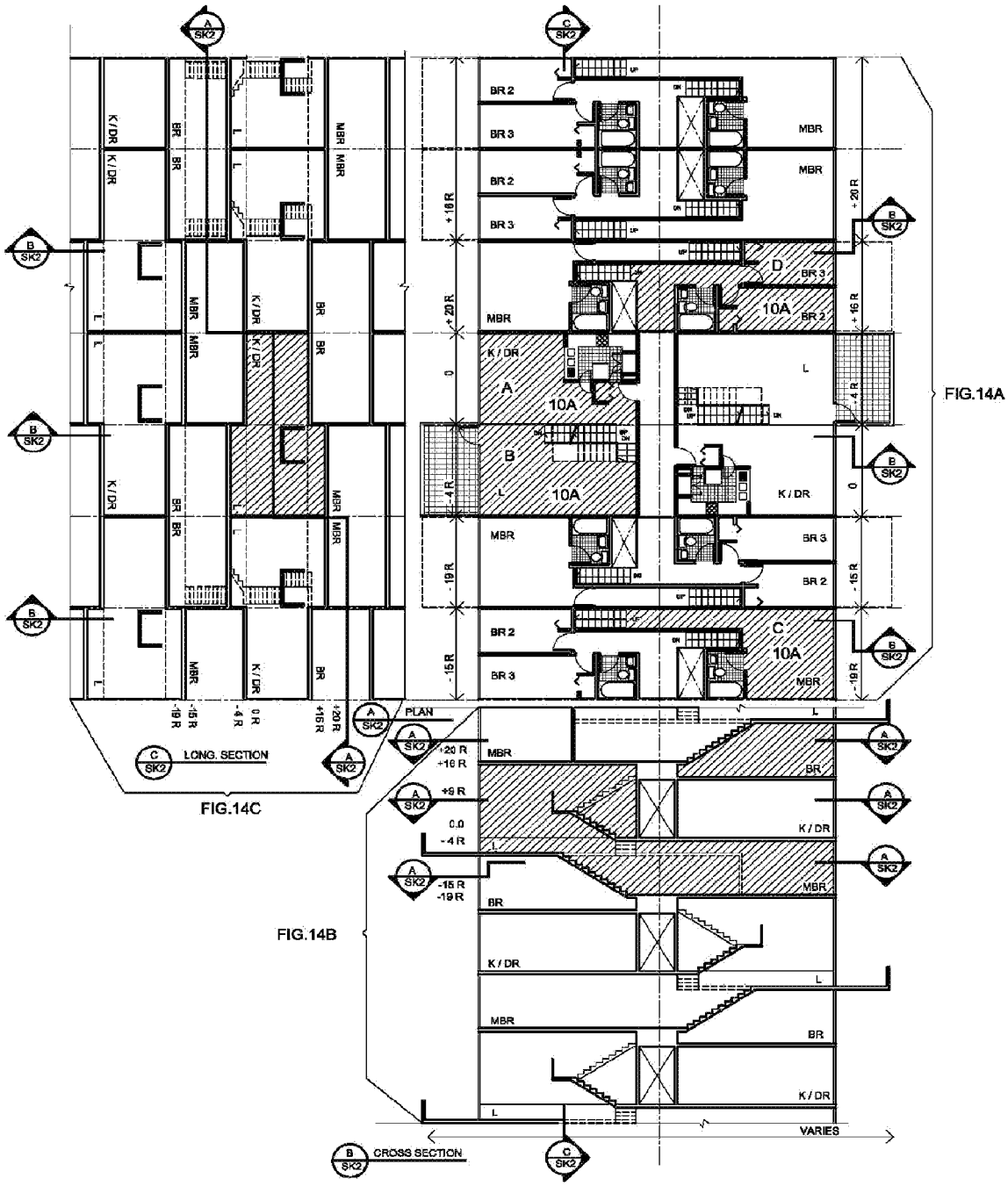
FIG. 14A shows orthographic plans.
FIG. 14B shows cross sections and FIG. 14C shows a longitudinal section of a plurality of identical apartments in an apartment building mirrored in one horizontal axis on one side of a public corridor and rotated 180 degrees in the other axis across the public corridor where the apartments include a third preferred stairway system in accordance with the present invention.
Figures 15A, 15B, 15C:
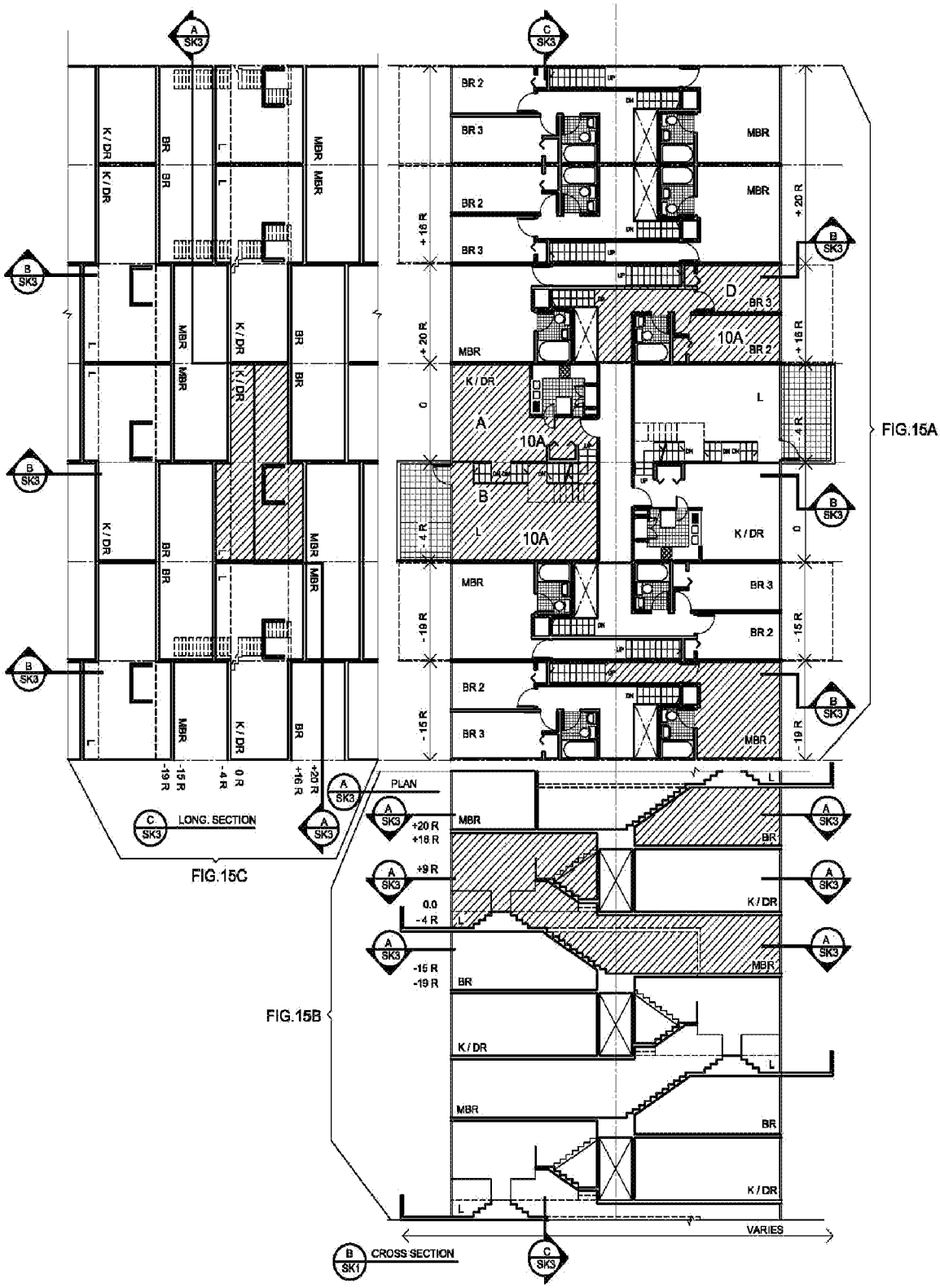
FIG. 15A shows orthographic plans.
FIG. 15B shows cross sections and FIG. 15C shows a longitudinal section of a plurality of identical apartments in an apartment building mirrored in one horizontal axis on one side of a public corridor and rotated 180 degrees in the other axis across the public corridor where the apartments include a fourth preferred stairway system in accordance with the present invention.

In alternative preferred embodiments, each of the apartments 10 in the apartment building 11 can include an alternative second preferred embodiment of the stairway system 30 as shown in FIGS. 13A, 13B and 13C, an alternative third preferred embodiment of the stairway system 30 as shown in FIGS. 14A, 14B and 14C, or an alternative fourth preferred embodiment of the stairway system 30 as shown in FIGS. 15A, 15B and 15C, where each of the stairway systems provide for the configuration of the Modules A, B, C and D on corresponding levels as required by the present invention.

Referring to FIG. 9, in a preferred embodiment of the apartment 10A the function space of a living room included in the Module B at the level 38 has a duplex height extending between the floor level 38 and a ceiling. A part of the ceiling nearest to the internal balcony is of triplex height such that the ceiling plane of the Module D is visible from the Module B. In addition, the function space of a kitchen contained in the Module A at the level 32 has an intermediate height extending between the floor level 32 and a ceiling 33. Further, the function space of a master bedroom and bathroom contained in the Module C at the level 44 and a minor bedroom and bathroom contained in the Module D at the level 68 have a conventional height. The intermediate height is between the duplex height and the conventional height but greater than standard head room. The heights of the respective levels of the apartment 10 are selected to conserve overall volumetric space or bulk within a multi-apartment building, where the height is selected to avoid allocating extra volumetric space to function space that would not be beneficial to the apartment functions associated with the respective space. For example, having a bathroom that has a duplex height would not benefit the conventional functions associated with a bathroom where an intimate ambience is preferred.

Referring to FIG. 6, the living room function space in the Module B on the level 38 has a vertical duplex height and includes an exterior floor to ceiling window that permits clerestory day-lighting deep into the interior of the apartment 10.

Referring to FIGS. 8 and 10, in a preferred embodiment the stairway system 30 is exposed in duplex height space and includes ornamental features. In addition, the upper bedroom level 68 includes an interior balcony region 69 that overlooks the duplex height space of the living room level 38. The balcony region 69, which is of greater than conventional height in that it is part of the level 68, thus provides for greater than standard head room.

In a further preferred embodiment, the living room function of the level 38 of the Module B is visible from the Module D to connect the Module B and Module D spaces visually with the stairway system 30. Portions of the Module A space are also visible from the Module D. Thus, the illusion of spaciousness is provided because the stairway system, including the platform, and most levels of the apartment are visible from the interior balcony region 69.

Referring to FIGS. 1, 3B and 10, external balconies 40 may extend from either or both the dining and living room levels 32 and 38 of the Modules A and B, respectively, from each of the apartments 10. The arrangement of the vertically adjacent apartments 10 in the building 11, thus, provides for balconies 40 serving identical functions at vertical intervals of five stories on each side of the building 11.

Figure 4A:
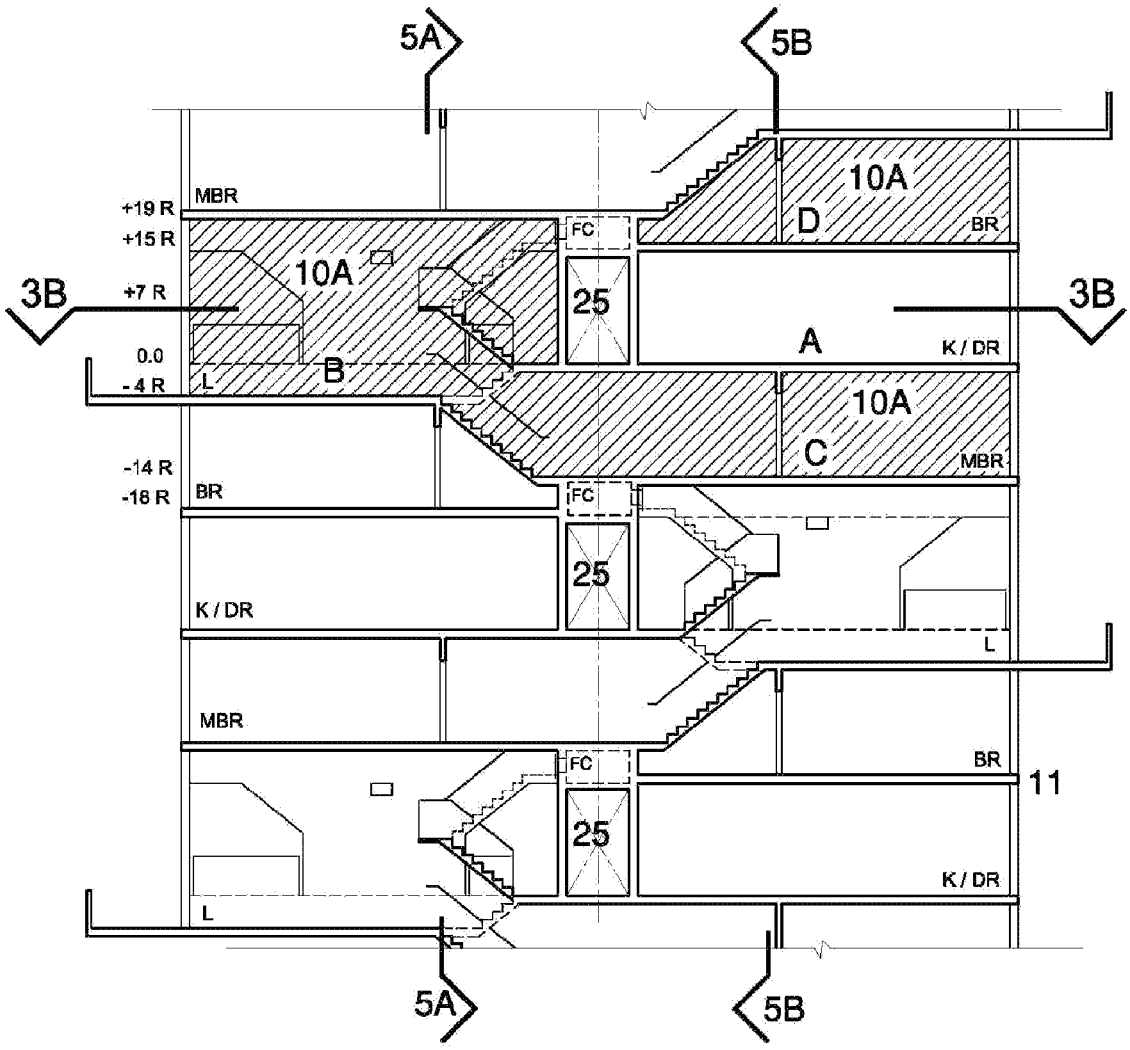
FIGS. 4A, 4B and 4C are cross-sections taken at lines 4A-4A, 4B-4B and 4C-4C, respectively, of the apartments of the building of FIGS. 3A, 3B, 3C and 3D.
Figure 4B:
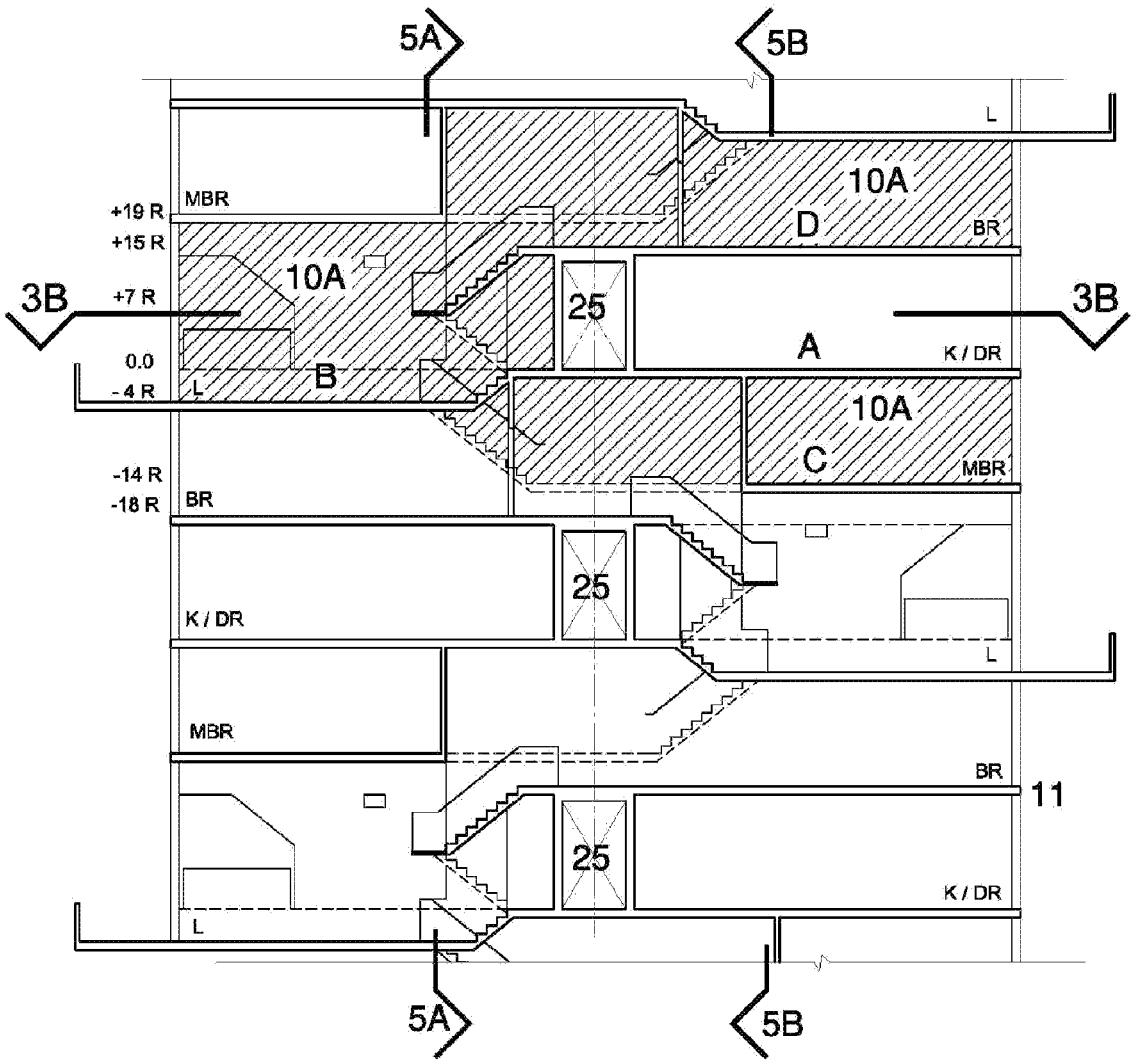
Figure 4C:
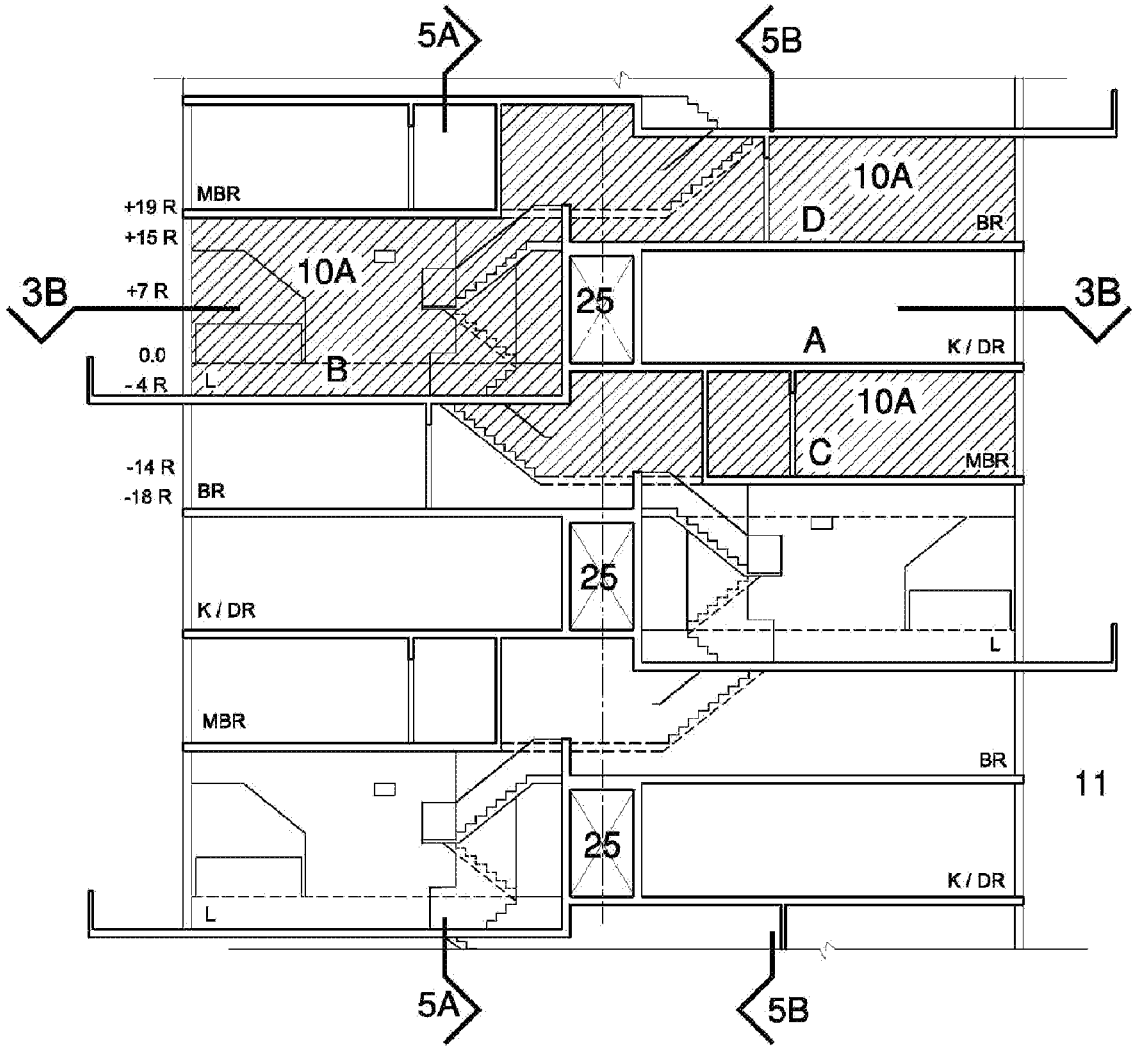
Figure 5:
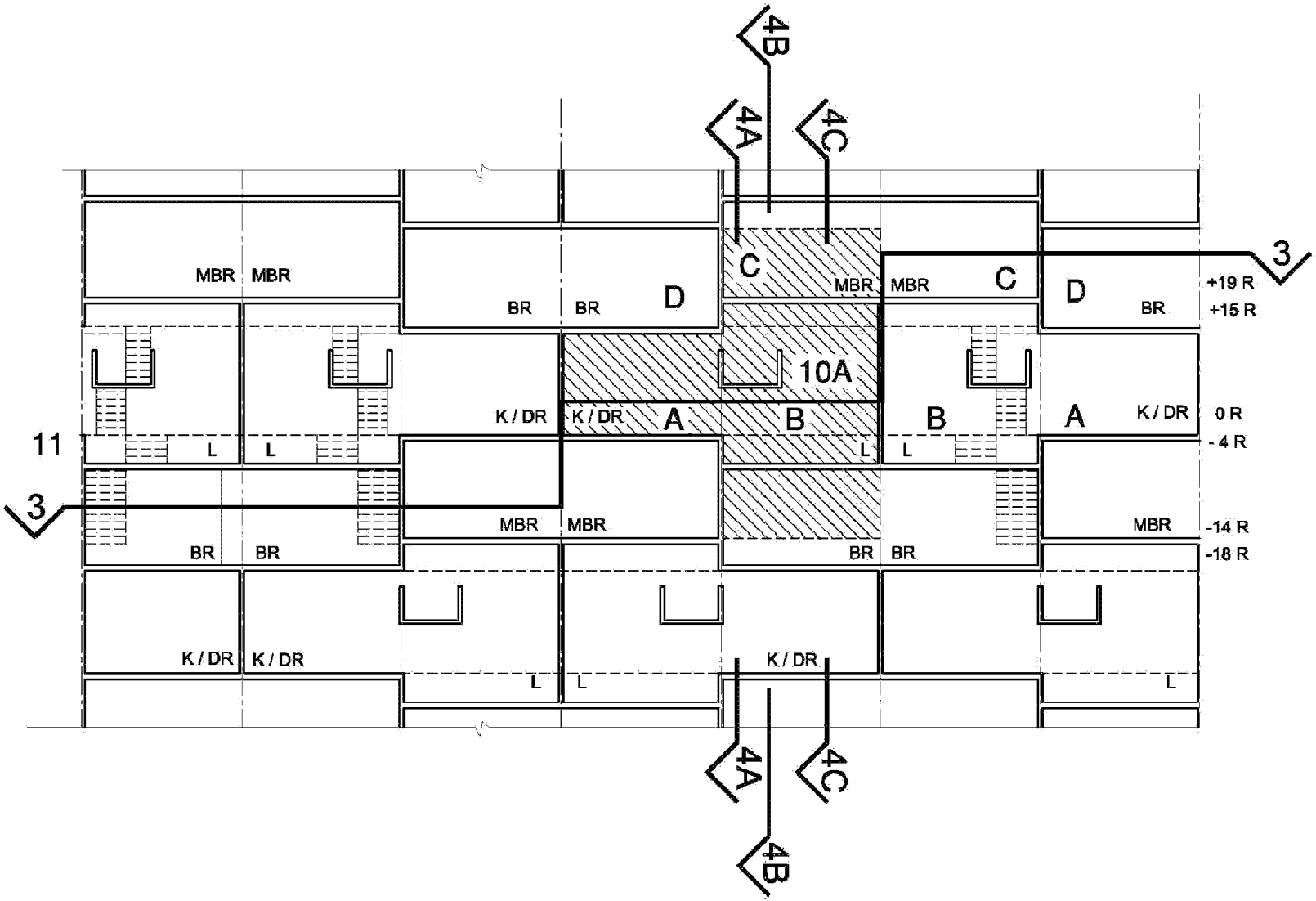
FIG. 5 is a longitudinal section of the apartment building of FIGS. 3A, 3B, 3C and 3D taken through lines 5-5.

In a preferred embodiment, excess height in the public corridor 25 beneath the interior corridor 29 connecting the Module C to the Module B of the adjacent apartment above provides concealed space for a suspended fan-coil unit, indicated as FC in FIG. 4A, supplying conditioned air to the adjacent Modules A and B of an apartment and the possibility of having a short return air connection from the Module B to the unit. Therefore, a dedicated temperature control unit is provided for the major Modules A and B in each apartment without consuming floor area.

In a preferred embodiment, the apartments 10 provide simple, planar facades that minimize the exposed surface-to-volume ratio for a building 11, thereby minimizing energy loss in the apartment.

Thus, the apartments constructed for inclusion in an apartment building in accordance with the present invention combine the features typical of a detached house while conferring the additional advantages to land use, constructability, and sustainable development that are characteristic of high rise apartment buildings. The inventive apartment 10 design optimizes the use of volume in a multistory apartment building where horizontal floor area is limited. The volumes associated with the respective function spaces for the four levels of an apartment are joined by the stairway system 12 that is coupled to a vertically extending support assembly. In addition, the design of the apartment reduces energy consumption in relation to comparable detached residences, because the lower external surface to volume ratio for the apartment achieves a reduction in energy losses from exposed surfaces. In addition, the apartment satisfies conventional, structural stacking requirements of having a "safety room" in each apartment of a building against explosive attack where mandated by safety codes. The central location of the double-loaded public corridor permits a compact passenger lobby plan and flexible location of stair and elevator cores at ends or junctures in public corridors of a multistory apartment building.

It is to be understood that the dimensions, such as the height dimensions, for the respective Modules A, B, C and D of an apartment 10 in a multi-apartment building can be selected, as desired or suitable, such as to increase external window surface and head room which in turn increases volumetric space per apartment for the building, while maintaining the shape and diagrammatic relationship among the modules for each of the apartments in accordance with the present invention. The height and floor dimensions are preferably selected to conserve floor area in view of a zoning constraint and to provide for optimum utilization of occupied and ancillary volumes in a multi-apartment building. It is also to be understood that various ancillary spaces can be included within the modules of the inventive apartment without departing from the principles of the invention. It is also to be understood that the master bedroom function space can occupy the Module D and the minor bedroom function space can occupy the Module C in the inventive apartment.

Although preferred embodiments of the present invention have been described and illustrated, it will be apparent to those skilled in the art that various modifications may be made without departing from the principles of the invention.

What is claimed is:

1. A multi-level building system comprising: a plurality of vertical sections, wherein each vertical section includes at least one pair of first and second apartments and wherein the first apartment of the pair is rotated 180 degrees in plan, in relation to the second apartment of the pair, and about a public corridor;

a vertically extending stair support wall assembly in each of the first and second apartments, respectively, of the at least one pair, wherein each of the stair support assemblies includes first and second opposing major faces and first and second opposing lateral faces, wherein the first lateral face faces a wall of the public corridor through which the apartment is entered, wherein the first lateral face is spaced from the entry wall of the public corridor for permitting passage between the entry wall and first lateral face;

wherein each of the first and second apartments includes first, second, third and fourth levels of function space connected by a stairway system coupled to the stair support assembly; and wherein the stairway system comprises:

a first set of risers defining a first stairway of a first vertical height, wherein the first set of risers extends along the first major face of the stair support assembly and between a first landing at the level of the public corridor and a second landing, wherein the second landing is less than one-half story below the plane of the first landing and wherein the first and second landings are at the first and second levels, respectively, wherein the first landing abuts the first lateral face of the stair support assembly and extends horizontally away from the second major face of the stair support assembly to the first function space, wherein the second landing abuts the second lateral face of the stair support assembly and a portion of the first major face and extends horizontally away from the first major face and second lateral face to the second function space;

a second set of risers defining a second stairway of a second vertical height, wherein the second set of risers extends along the second major face of the stair support assembly and between the second landing and a third landing, wherein the third landing is below the plane of the second landing, wherein the third landing is at the third level which extends horizontally away from the lowest riser of the second stairway to the third function space, wherein the third function space extends beneath and away from the public corridor in a direction opposite to that of the direction of entry into the apartment;

a third set of risers defining a third stairway of a third vertical height, wherein the third set of risers extends along the second major face of the stair support assembly and between the first landing and a platform from which a level of function space does not extend horizontally away, wherein the platform is above the plane of the first landing and within the function space of the second level; and a fourth set of risers defining a fourth stairway of a fourth vertical height, wherein the fourth set of risers extends along the first major face of the stair support assembly and between the platform and a fourth landing, wherein the fourth landing is at the fourth level, is above the plane of the platform and extends horizontally away from the first lateral face to the fourth function space, wherein the fourth function space extends above the public corridor and away from the plane of the wall of the public corridor through which the apartment is entered in a direction opposite to that of the direction of entry into the apartment;

wherein each of the apartments in each of the vertical sections is arranged laterally in a mirrored relationship to each adjacent apartment about a demising wall, wherein the vertical sections next above and below are stacked such that the orientation of the apartments vertically aligned next above and below is the same as that of the mirrored apartments laterally adjacent.

2. The system of claim 1, wherein the second landing is a split-level distance below the first landing.

3. The system of claim 1, wherein the platform is sufficiently above the second landing to provide head room for passage on the second level.

4. The system of claim 1, wherein the first function space includes a dining room and kitchen, the second function space includes living room, the third function space includes a master bedroom and the fourth function space includes at least one minor bedroom.

5. The system of claim 4, wherein the first function space further includes a powder room, an entry wardrobe and ancillary space.

6. The system of claim 4, wherein the third function space further includes bathroom and ancillary space.

7. The system of claim 4, wherein the fourth function space further includes a bathroom, an interior balcony with ancillary space overlooking the living room of the second function space.

8. The system of claim 1, wherein the stair support wall assembly includes vertical service risers and is vertically and laterally aligned with a chase wall permitting direct passage of the risers without offsets, wherein the risers extend in sequence through the third, first and fourth levels in apartments above the stair wall assembly, and in sequence through the fourth, first and third levels respectively in apartments below the stair wall assembly, and through a next stair wall assembly above and below, exposed respectively at the second levels.

9. The system of claim 1, wherein each of the third and fourth levels has a minimum room height and wherein each of the first level and the public corridor has a height that is greater than the minimum room height.

10. The system of claim 1, wherein a same vertical section includes a plurality of apartment pairs, and the corridor for the same vertical section connects the first level corridor for the same vertical section connects the first level of the first apartment to the first level of the second apartment for each of the respective apartment pairs included in the same vertical section.

11. The system of claim 10, wherein the third and fourth levels of each of the apartments has an external view and the first and second levels of each of the apartments has an external view that is on the opposite side of the building system relative to the external views for the third and fourth levels.

12. The system of claim 1, wherein the second level has a room height equal to the sum of (i) twice the vertical distance between the first and second levels and (ii) the height of the first function space.

13. The system of claim 1, wherein the first and second apartments are identical.

14. A multi-level building comprising:

a plurality of vertical sections, wherein each vertical section includes at least one pair of first and second apartments and wherein the first apartment of the pair is rotated 180 degrees in plan, in relation to the second apartment of the pair, and about a public corridor having a floor and with a first height;

wherein each of the first and second apartments includes first, second, third and fourth levels of function space;

wherein the first level is substantially coplanar with the floor of the corridor and defines a first function space having a height equal to the first height, wherein the first height is greater than a minimum story height;

wherein the second level occupies a plane below the first level and defines a second function space having a height equal to (i) twice the vertical distance between the first and second levels, plus the height of the first function space or (ii) the sum of the vertical distance between the first and second levels, the height of the first function space and the vertical distance between first and second levels next above;

wherein the third level occupies a plane below the first level and defines a third function space having a height equal to a single story, wherein an extent of the third level, nearest the public corridor is excised, such that the width and length of a stair penetration can accommodate headroom for a stairway of an apartment next below, wherein the third level includes a corridor for connecting to a stair extending from the second level; and wherein the fourth level is substantially coplanar with a top of the first function space and defines a fourth function space having a height equal to a single story, wherein a height over a portion of the fourth level adjoining the excision for stair headroom includes an augmented vertical distance;

wherein the first and second levels extend from a wall of the public corridor through which the apartment is entered to a principle fenestrated façade on a same side of the building;

wherein the third level is below the plane of the public corridor and the fourth level extends over the public corridor, from the entry wall of the public corridor, to a principle fenestrated façade opposite the principle façade to which the first and second levels extend;

wherein each apartment pair in a first vertical section is arranged laterally in a mirrored relationship to each adjacent pair about a demising wall, wherein the vertical sections next above and below are stacked such that the orientation of the apartments vertically aligned next above and below is the same as that of the mirrored apartments laterally adjacent, wherein a first level of the first apartment of the first vertical section immediately overlies a third level of the second apartment of the apartment pair in the first vertical section, wherein a second level of the first apartment of the first vertical section immediately overlies a fourth level of the second apartment in the second vertical section, wherein a third level of the first apartment of the first vertical section immediately overlies a second level of the second apartment in the second vertical section, and wherein a fourth level of the first apartment of the first vertical section immediately overlies a first level of the second apartment in the first vertical section.

15. The system of claim 14, wherein each of the vertical sections is bounded by first and second vertically continuous load-bearing walls extending across the building from the one principle façade to the other principle façade, thereby demising each apartment pair from the next, wherein the first and second load-bearing walls are penetrated by the public corridor at the first level of the apartments of the apartment pairs of each of the vertical sections.

16. The system of claim 15 further comprising:

a third vertically continuous load-bearing wall located between the first and second levels within each of the apartments of the apartment pairs, extending parallel to the first and second load-bearing walls and toward the one principle façade and the other principle façade at the opposite sides of the building, and being penetrated by the public corridor and at least one interior passage, thereby separating and laterally supporting one side of the first and second levels within each of the apartments of the apartment pair, wherein the demising walls support the other side of the first and second levels.

* * * * *